United States Patent [19]

Stefansson et al.

[11] 4,257,324

[45] Mar. 24, 1981

[54] POSITION MONITORING METHODS AND APPARATUS

[75] Inventors: Rafn Stefansson, San Marino; Dwight G. Westover, Sierra Madre, both of Calif.

[73] Assignee: Bell & Howell Company, Chicago, Ill.

[21] Appl. No.: 955,858

[22] Filed: Oct. 30, 1978

[51] Int. Cl.[3] ..... B41J 1/44

[52] U.S. Cl. ..... 101/93.01; 101/93.22; 101/110; 101/99; 235/92 MP

[58] Field of Search ..... 101/93.22, 99, 110, 101/111, 93.01; 235/92 FQ, 92 MP, 92 EA

[56] References Cited

U.S. PATENT DOCUMENTS

| | | | |
|---|---|---|---|
| 2,239,460 | 4/1941 | Levy | 101/99 X |
| 2,447,588 | 8/1948 | McNairn | 235/92 MP |
| 3,118,096 | 1/1964 | Gavreau et al. | 235/92 MP |
| 3,141,403 | 7/1964 | Brown et al. | 101/99 |
| 3,896,298 | 7/1975 | Haydon | 235/92 EA X |
| 3,941,686 | 3/1976 | Juvinall | 235/92 MP X |
| 4,015,521 | 4/1977 | Neff | 101/99 |

FOREIGN PATENT DOCUMENTS

| | | | |
|---|---|---|---|
| 979493 | 1/1965 | United Kingdom | 235/92 MP |

*Primary Examiner*—Edward M. Coven
*Attorney, Agent, or Firm*—Benoit Law Corporation

[57] ABSTRACT

Methods and apparatus for ascertaining movement of a device from a first position to a second position couple a ratchet member and pawl combination to that movable device. Clicks indicative of the movement of the device are generated by effecting relative motion between the ratchet member and pawl in accordance with the movement of the device from the first to the second position. An ascertainment is then made from the generated clicks whether the movement of the device has in fact resulted in the desired movement from the first to the second position. The invention is of particular utility in the monitoring of character segments in printing devices, but is not limited to such an application.

23 Claims, 4 Drawing Figures

COMP
COUNTER
SEL
10
12
13
14
15
18
20
23
27
28
32
33
34
35
37
38
39
41
42
45
46
48
49
51
53
54
56
57
61
63
65
66
68
69
71
72
78
81
82
84
91
92
94
96
98
99
100
102
104
105
106
107
108
109
112
123
124
125
128
133
161
162
164
165
173
186
187
188
189
193
194
196
197
198
199
200
201
203

POSITION MONITORING METHODS AND APPARATUS

BACKGROUND OF THE INVENTION

1. Field of the Invention

The subject invention relates to motion and position monitoring systems and, more specifically, to methods and apparatus for ascertaining movement of a device to a predetermined position, for ascertaining the existence of a predetermined relative position between a ratchet member and a pawl, and to methods and apparatus for operating a movable character printing device or for monitoring movable characters or charactering bearing segments in printing equipment.

2. Prior-Art Statement

An advanced prior-art character printing apparatus is disclosed in U.S. Pat. No. 4,015,521, by Joseph J. Neff, issued Apr. 5, 1977 to the subject assignee. In that apparatus, a plurality of mutually parallel character segments are individually adjusted to various angular positions for a printout of different number or character combinations. This type of apparatus is enjoying a widespread increasing use in several applications where accuracy of the printout is indispensable. For instance, one growing application involves the processing and recordation of incoming, previously invoiced payments in utility companies, periodical publishing houses and similar institutions. Large banks have also commenced to use this type of printing equipment in their internal negotiable instrument and payment processing operations.

In brief, myriads of bank checks, payment stubs and other papers are processed each hour by the type of equipment shown in the above mentioned patent, so that even a printing error rate of as low as one in ten thousand could have very grave effects. Unfortunately, existing double-checking systems for detecting printing errors tend to be more onerous and distractive than the basic paper processing and printing operation itself. Equally unfortunately, numerous factors, such as power supply or solenoid failure, wear, breakage, jamming or stickiness of mechanical parts, contribute to the potential failure of printing segments to advance to their proper intended positions at every instant.

There thus exists a serious need for methods and apparatus for ascertaining movement of a device from a first position to a second position. Unfortunately, the prior art has inadequately met this need as to a variety of applications. For instance, U.S. Pat. Nos. 3,131,627, 3,596,593, 3,640,216, 3,654,860, 3,742,844 and 4,078,485 basically pursue prior-art approaches by providing and employing various extra clock wheel and pickup coil systems, cam, cam follower and transducer pickup combinations, code disc and commutator time pulse generating apparatus and similar additional equipment. The contents of U.S. Pat. Nos. 3,422,754, 3,730,085, 3,822,640, 4,033,256 and the patents of record in the above mentioned Neff U.S. Pat. No. 4,015,521 may also be of interest in this respect.

SUMMARY OF THE INVENTION

It is a general object of this invention to overcome the above mentioned disadvantages and satisfy the above mentioned needs.

It is a germane object of this invention to provide improved methods and apparatus for ascertaining movement of a device from a first position to a second position.

It is a related object of this invention to provide improved methods and apparatus for ascertaining the position of a movable device.

It is a related object of this invention to provide methods and apparatus for ascertaining the existence of a predetermined relative position between a ratchet member and a detent member.

It is also an object of this invention to provide improved methods and apparatus for operating and monitoring a movable character printing device.

It is a related object of this invention to provide improved printing equipment.

It is also an object of this invention to improve the accuracy of negotiable instrument, commercial paper, information and data processing and monitoring operations.

Other objects are apparent from the further course of this disclosure.

From one aspect thereof, the subject invention resides in a method of ascertaining the existence of a predetermined relative position between a ratchet member and detent member, comprising in combination the steps of applying the detent member to the ratchet member, generating clicks by effecting relative movement between the ratchet member and applied detent member in order to realize said relative position, and ascertaining from said generated clicks the attainment of said relative position.

From another aspect thereof, the subject invention resides in a method of ascertaining movement of a device from a first position to a second position, comprising in combination the steps of coupling a ratchet member and detent member combination to said movable device, attempting movement of said device from the first to the second position, generating clicks indicative of said movement by effecting relative motion between the ratchet member and detent member of said coupled ratchet and detent member combination in accordance with the movement of said device, and ascertaining from said clicks whether said attempted movement has resulted in movement of said device from the first to the second position.

From another aspect thereof, the subject invention resides in a method of operating a movable character printing device, comprising in combination the steps of coupling a ratchet member and detent member combination to said character printing device, designating a character of said printing device for printout, attempting movement of said character printing device for presentation of said character for printout, generating clicks indicative of said movement by effecting relative motion between the ratchet member and detent member of said coupled ratchet and detent member combination in accordance with said movement, ascertaining from said clicks whether said attempted movement has resulted in presentation of said character for printout, inhibiting printout as long as said attempted movement has failed to result in said presentation of said character, and effecting printout when said attempted movement has resulted in said presentation of said character.

From another aspect thereof, the subject invention residues in apparatus for ascertaining the existence of a predetermined relative position between a ratchet member and a detent member, comprising, in combination, means coupled to the detent member for applying the detent member to the ratchet member, means for generating clicks by effecting relative movement between the ratchet member and applied detent member in order to realize said relative position, and means coupled to said generating means for ascertaining from said generated clicks the attainment of said relative position.

From another aspect thereof, the subject invention resides in apparatus for ascertaining movement of a device from a first position to a second position comprising, in combination, means for generating clicks including a ratchet member and detent member combination, means coupled to said device for moving said device from said first to said second position, means coupled to said ratchet and detent member combination and to said device for effecting relative motion between the ratchet member and detent member in said ratchet and detent member combination and generation of said clicks in accordance with the movement of said device, and means coupled to said generating means for ascertaining from said generated clicks whether said moving means have moved said device from the first to the second position.

From another aspect thereof, the subject invention resides in apparatus for printing characters, comprising in combination a movable character printing device, means coupled to said movable character printing device for presenting any character of said character printing device for printout, means for generating clicks including a ratchet member and detent member combination, means for designating a desired character in said character printing device for printout, means coupled to said designating means, presenting means and ratchet and detent member combination for moving said character printing device for presentation of said desired character for printout and effecting relative motion between the ratchet member and detent member in said ratchet and detent member combination and generation of said clicks in accordance with the movement of said character printing device, means coupled to said designating means and generating means for ascertaining from said clicks whether said moving means have moved said character printing device for presentation of said desired character for printout, and means connected to said ascertaining means for inhibiting printout as long as said moving means have failed to move said character printing device for presentation of said desired character for printout and for effecting printout upon ascertainment that said desired character is being presented for printout.

From another aspect thereof, the subject invention resides in a method of ascertaining the existence of a predetermined relative position between a first member having a series of structural discontinuities and a second member elastically deformable by the structural discontinuities, comprising in combination the steps of effecting relative movement between the first and second members in order to realize said position and generating elastic deformations in the second member with the structural discontinuities during the relative movement, transducing the elastic deformation into electic signals, and ascertaining attainment of said relative position from the electric signals.

From another aspect thereof, the subject invention resides in a method of ascertaining amount of movement of a device, comprising in combination the steps of providing a first member with a series of structural discontinuities and a second member elastically deformable by the structural discontinuities, effecting relative movement between the first and second members in proportion to movement of the device and generating elastic deformations in the second member with the structural discontinuities during the relative movement, transducing the elastic deformations into electric signals, and ascertaining the amount of movement of the device from the electric signals.

From another aspect thereof, the subject invention resides in a method of ascertaining amount of movement of a device, comprising in combination the steps of providing a first member with a series of structural discontinuities and a second member elastically deformable by the structural discontinuities, effecting relative movement between the first and second members in a first sense in proportion to movement of the device in a first direction and generating first elastic deformations in the second member with the structural discontinuities during the relative movement in the first sense, effecting relative movement between the first and second members in a second sense in proportion to movement of the device in a second direction and generating second elastic deformations in the second member with the structural discontinuities during the relative movement in the second sense, transducing the first elastic deformations into first electric signals, transducing the second elastic deformations into second electric signals, and determining amount of movement of the device from the first and second electric signals.

From another aspect thereof, the subject invention resides in apparatus for ascertaining the existence of a predetermined relative position between a first member having a series of structural discontinuities and a second member elastically deformable by the structural discontinuities, comprising, in combination, means for effecting relative movement between the first and second members in order to realize said relative position and for generating elastic deformations in the second member with the structural discontinuities during the relative movement, means coupled to the second member for transducing the elastic deformations into electric signals, and means connected to the transducing means for ascertaining attainment of said relative position from the electric signals.

From another aspect thereof, the subject invention resides in apparatus for ascertaining amount of movement of a device, comprising in combination a first member having a series of structural discontinuities, and a second member elastically deformable by the structural discontinuities, means coupled to the device and at least one of the members for effecting relative movement between the first and second members in proportion to movement of the device and for generating elastic deformations in the second member with the structural discontinuities during the relative movement, means coupled to the second member for transducing the elastic deformations into electric signals, and means connected to the transducing means for ascertaining the amount of movement of the device from the electric signals.

From another aspect thereof, the subject invention resides in apparatus for ascertaining amount of movement of a device, comprising in combination a first member having a series of structural discontinuities, a second member elastically deformable by the structural discontinuities, means coupled to the device and at least one of the members for effecting relative movement between the first and second members in a first sense in proportion to movement of the device in a first direction and generating first elastic deformations in the second member with the structural discontinuities during the relative movement in the just sense and for effecting relative movement between the first and second members in a second sense in proportion to movement of the device in a second direction and generating second elastic deformations in the second member with the structural discontinuities during the relative movement in the second sense, means coupled to the second member for transducing the first elastic deformations into first electric signals and for transducing the second elastic deformations into second electric signals, and means connected to the transducing means for determining amount of movement of the device from the first and second electric signals.

From other aspects thereof, the subject invention resides also in methods and apparatus for ascertaining the existence of a predetermined relative position between a ratchet member and a leaf spring, wherein the ratchet member is provided with ratchet teeth each having a projecting edge, a transducer element emitting an electric signal in response to bending is coextensive with part of the leaf spring, the leaf spring is applied to the ratchet member and relative movement between the ratchet member and the leaf spring is effected in order to realize said relative position and to cause the leaf spring to ride up on a tooth at a time and bend the partially coextensive transducer element and to snap back off the projecting edge of the tooth. An electric signal is emitted with the transducer element each time the bent transducer element snaps back after the leaf spring. Attainment of the desired relative position is ascertained from electric signals thus emitted. In the context of an apparatus, means for emitting electric signals may include means for rendering the transducer element coextensive with part of the leaf spring for bending of, and emission of an electric signal by, the transducer element each time the leaf spring snaps back off a projecting edge of a ratchet tooth.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
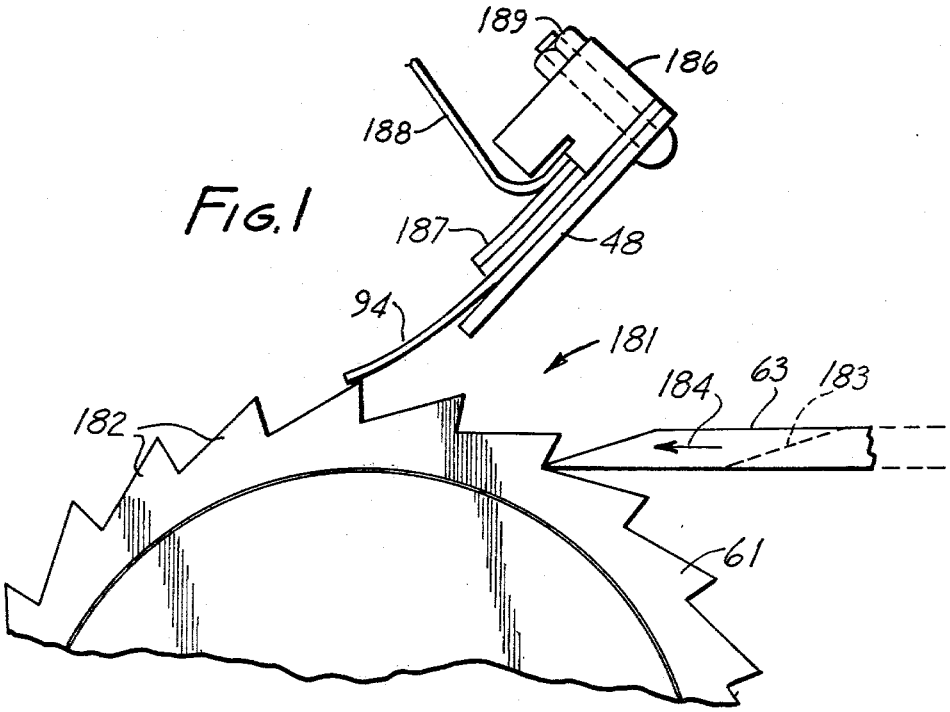
FIG. 1 is a fractional view of the heart of a monitoring apparatus in accordance with a preferred embodiment of the subject invention.

The part of the monitoring apparatus 181 shown in FIG. 1 has a ratchet member 61, a pawl 63 and a detent member or leaf spring 94. The combination of elements shown in FIG. 1 may, but need not necessarily, form part of the printing apparatus shown in FIG. 3 and described in more detail below.

The ratchet wheel 61, around its circumference, has the familiar ratchet teeth sloping in one direction to be engageable and advanceable by the pawl 63 and releasably retainable by the detent spring 94. At this juncture, and throughout the subject disclosure, it should be noted and kept in mind that the ratchet wheel 61 is but one illustrative example of a ratchet member usable in the practice of the subject invention. By way of example, and with reference to U.S. Pat. No. 2,039,791, by F. J. Furman, issued May 5, 1936, and herewith incorporated by reference herein, the ratchet member employed in the practice of the subject invention may be a linear ratchet member or ratchet bar which is engaged by pawl and detent members in the context of a movable character printing device or in any other context.

The pawl 63 intermittently juts from a rest position shown in dotted outline at 183 and in the direction of arrow 184 against the ratchet wheel 61 in order to sequentially engage and advance the ratchet teeth 182.

Every time the ratchet wheel 61 is advanced one notch or tooth, the detent spring 94 rides up the particular tooth as shown in FIG. 1 and finally snaps off that tooth as the wheel completes the particular step of its movement. Each time the detent spring 94 snaps off the steep side of a tooth 182, it generates and emits the familiar click heard in the operation of ratchet mechanisms in general. In other words, the type of click herein referred to is the familiar sharp motion occurring when a hard object snaps into place against another hard object.

Figure 3:
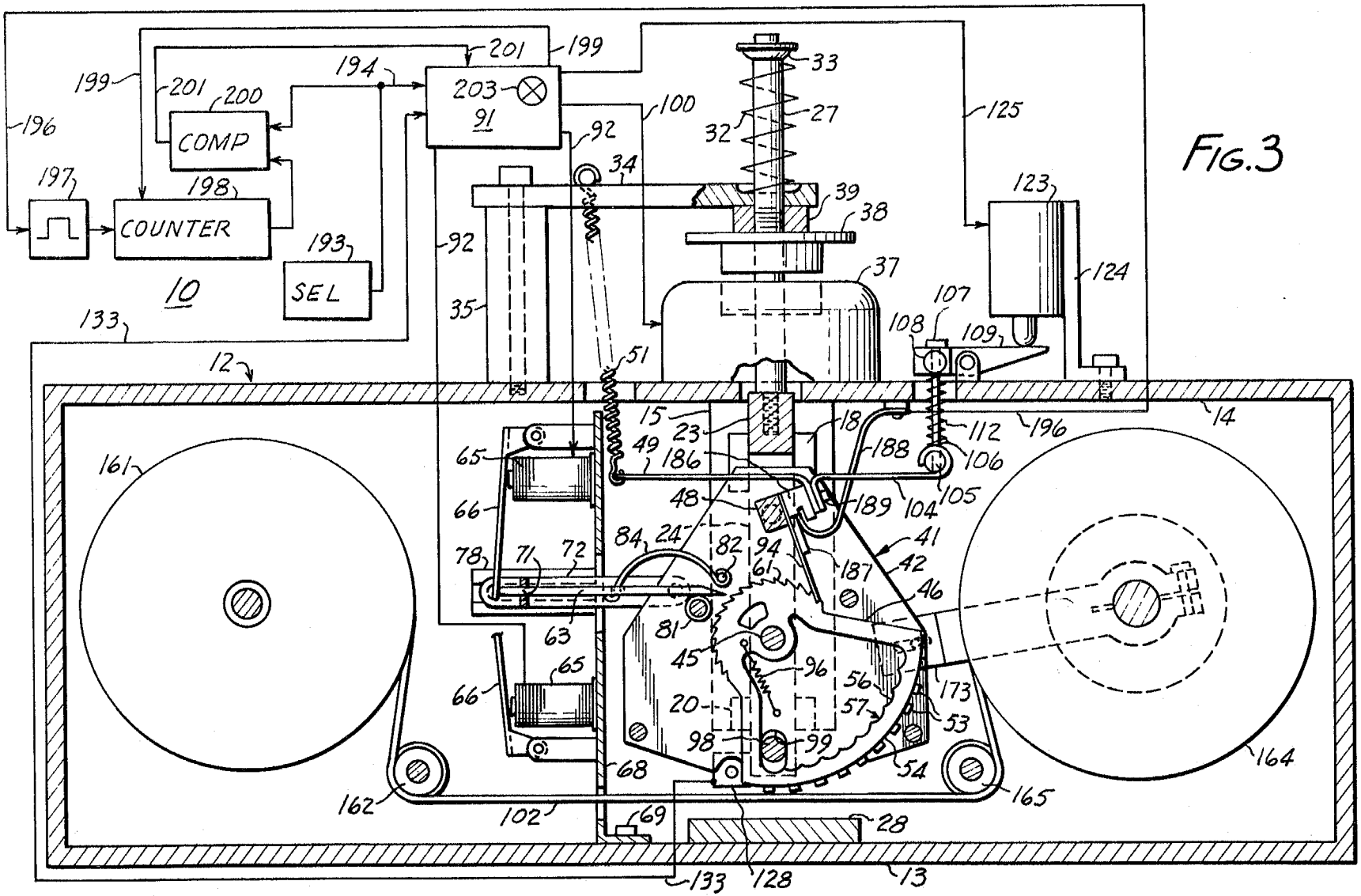
FIG. 3 is a side view, partially in section, of a printing apparatus in accordance with a preferred embodiment of the subject invention.

The detent spring 94 is retained between a pair of mounting members 48 and 186. The mounting member 48 is a rectangular mounting bar which, as shown in FIG. 1, may be relatively flat or, as shown in FIG. 3, closer to a square configuration.

The mounting member 186 retains a transducing element 187 for translating or transducing the clicks generated by the detent spring 94 into electric signals which are transmitted via a flexible lead 188 and which, as more fully disclosed below, may be employed for ascertaining the attainment of a relative position between the ratchet wheel 61 and detent member 94 or pawl 63.

In principle, and within the broad contemplation of the subject invention, various types of transducers or sensors may be employed at 187 for picking up the clicks of the detent spring 94. By way of example, and not by way of limitation, strain gauges or proximity sensors could be employed at 187. Also, the members 48, 94 or 186 may act as one terminal, such as ground, for the element 187, with a lead 188 being connected to the other terminal to conduct the signal generated by element 187.

In accordance with a preferred embodiment of the subject invention, a piezoelectric element is employed at 187 preferably in the form of a ceramic beam. In this respect, the best mode presently known to the inventors for carrying the subject invention into effect resides in the employment at 187 of a piezoelectric ceramic of a construction generally known as "bimorph". Reference may, in this respect, be had to the contents of the article "Consider Piezoelectric Ceramics" by Dr. Thomas G. Reynolds III and David M. Tanka, in ELECTRONIC DESIGN, Vol. 25, No. 19 (Sept. 13, 1977) pp. 92–97. The bimorph is herein preferred beause of its economy, ease of packaging, availability and large signal generation efficiency which dispenses with the need for extensive amplification of the generated signal pulses.

In the illustrated preferred embodiments herein shown, the transducer element 187 is coextensive with part of the detent leaf spring 94, and such leaf spring and partially coextensive transducing element 187 are sandwiched between the mounting members 48 and 186 with the aid of one or more fastening devices 189.

In the context of the printing apparatus shown in FIG. 3, or quite apart from such context, the embodiment so far described with reference to FIG. 1 monitors the operation of the ratchet wheel 61 and, in this respect, permits the carrying out of a method of ascertaining the existence of a predetermined relative position between the ratchet member 61 and the detent member 94. That method includes the steps of applying the detent member 94 to the ratchet member 61, generating clicks by effecting relative movement between the ratchet member 61 and applied detent member 94 in order or in an effort to realize a desired relative position between the ratchet and detent members 61 and 94.

In this connection, it may be noted that the practice of the subject invention is not limited to a rotation or translatory motion of the ratchet member 61 with respect to a relatively stationery detent member 94. Rather, the required clicks may also be generated by moving a detent member over the teeth or with respect to a relatively stationary ratchet wheel, bar or other member.

In either case, the attainment of the desired relative position is ascertained from the generated clicks or then from electric signals indicative of such clicks.

Figure 2:
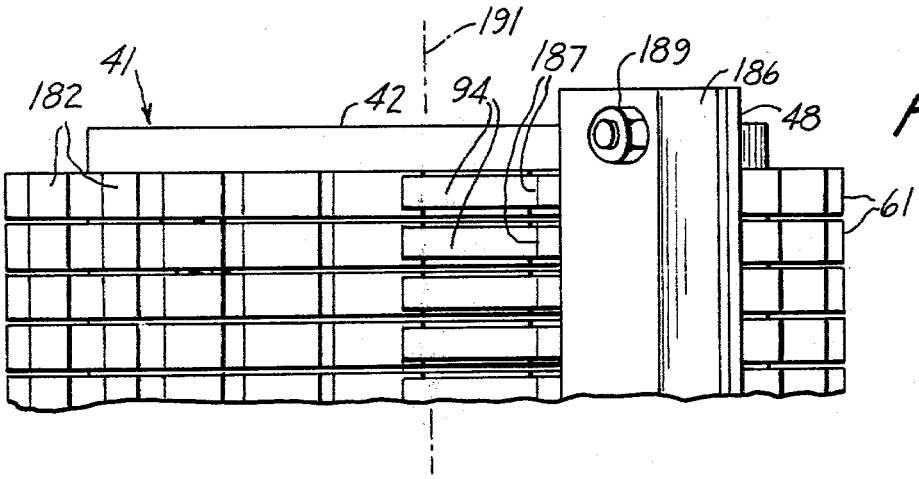
FIG. 2 is a top view of the equipment shown in FIG. 1.

The monitoring equipment illustrated in FIG. 1 has utility with only one ratchet wheel or member 61, detent member 94 and transducer element 187. As shown in FIG. 2, however, the relatively simple construction of the illustrated preferred embodiment permits the elements of the monitoring apparatus of the illustrated preferred embodiment of the subject invention to be used in large numbers with the additional components needed for the practice of the subject invention adding next to nothing to the expense and bulk of the resulting apparatus.

For instance, and as shown in FIG. 2, several ratchet wheels 61 may be mounted side by side or in mutually parallel relationship for individual rotation about an axis 191. To this end, a mounting frame 41 may include a pair of mounting plates 42 which have the ratchet wheels 61 disposed therebetween. The detent spring 94 may be provided individually for each ratchet wheel 61.

Preferably, however, the detent springs 94 may be worked out of a spring plate retained between the mounting members 48 and 186 and having the detent elements 94 projecting as tines therefrom. To permit individual monitoring of the motion or position of each ratchet wheel, each of the detent elements or tines 94 is provided with its own transducing element 187.

Reference will now be had to FIG. 3 for a showing of an example of a method and apparatus of ascertaining the movement of a device, such as a print wheel segment 46 from a first or rest position to a second or printout position. As will be shown with the aid of FIG. 3, the combination of ratchet member 61 and detent member 94 shown in FIG. 1 is coupled to the movable device 46. Movement of that device from the first to the desired second position is then effected or at least attempted with the aid of a pawl 63. Clicks indicative of such movement are generated by effecting relative motion between the ratchet member 61 and detent member 94 of the disclosed coupled ratchet and detent member combination in accordance with the movement of the device 46. From such generated clicks it is then ascertained whether the attempted movement has resulted in actual movement of the device 46 from the first to the desired second position.

Considering the latter statements and the apparent broad scope of the subject invention in general, it is easily seen that the utility of the subject invention extends generally to the monitoring of various kinds of moving devices, whereby it is not even necessary that such moving device be driven by the pawl and ratchet combination coupled thereto.

Rather, the monitored device may be rotated or driven by a drive separate from the ratchet member 61, the pawl 63 may be dispensed with, and the ratchet member 61 and applied detent member 94 may simply be employed to generate the requisite clicks, which may then, for instance, be transduced to electric signals by a device 187 or which may otherwise be monitored to ascertain the attainment of the desired motion or position of the monitored device.

As will also be shown with the example of FIG. 3, and as should be noted here generally as to the broad scope of the subject invention, the electric signals produced by the transducing device 187 and applied to an output lead 188 may be counted in order to count the clicks and to ascertain from the number of the counted clicks whether the attempted movement has resulted in movement of the device from a first to a desired second position or whether a desired relative position has been attained by the ratchet member 61 or by any device connected thereto. The character printing apparatus shown in FIG. 3 is similar to the above mentioned Neff patent, which is incorporated by reference herein, and reference should be had to that Neff patent for any details of the illustrated printing apparatus, except for the details concerning the subject invention and its preferred embodiments.

The character printing apparatus 10 shown in FIG. 3 has a housing 12 including a base 13 and a top plate 14. A pair of support and guide bars 15 is located in the housing 12 and is attached to the top plate 14. The bars 15 carry top guides 18 and bottom guides 20. A yoke 23 has legs 24 slidably disposed in the guide members or linear bearings 18 and 20.

A rod 27 is attached to the yoke 23 and is biased in a direction away from a platen 28 or, in other words, away from the printout surface of a card, check or other printout medium (not shown). This biasing action is performed on the rod 27 by a spring 32 which acts between a flange or plate 33 attached to the free end of the rod 27 and a bracket 34 attached to the top plate 14 via a spacer 35.

A solenoid 37 is attached to the top plate 14 in order to advance the rod 27 against the bias of the spring 32. To this end, the solenoid 37 may have an anchor 38 attached to the rod 27. A stop nut 39 is threaded on the rod 27 and is adjustable thereon by rotation in order to control the throw of the yoke 23.

A print segment carriage 41 has two side plates 42 (see also FIG. 2). The carriage 41 includes a shaft 45 extending between and attached to the side plates 42 for mounting a set of printing segments 46 side by side and for individual angular movement about the longitudinal axis of the shaft 45.

A mounting member or shaft 48, which is of square or rectangular configuration in the illustrated embodiment, has opposite ends pivoted in the carriage plates 42. An arm 49 is attached to the square shaft 48 by the fastener 189 and has a free end engaged by a spring 51 which acts between the bracket 34 and the arm 49 in order to bias the carriage 41 to a rest position away from the platen 28 or printout surface. The carriage 41 thus mounts the segments 46 for movement toward and away from the printout surface perpendicularly to the longitudinal axis of the shaft 45.

Each of the segments 46 has a series of character types 53 on an outer curved surface 54 and a distinct notch 56 behind each of the character types 53 in an inner curved surface 57. In the illustrated embodiment, the segments 46 have a quadrantal configuration. However, the broad aspect of the invention is not so limited, as the segments or elements carrying the character types 53 could, for instance, be circular or semicircular or have another desired configuration.

Each segment 46 in the illustrated preferred embodiment has a ratchet teeth structure 61 which permits a selective positioning of the character types 53 adjacent the printout surface, for a selection of the various character combinations to be printed by the apparatus 10. Each segment 46 has operatively associated therewith an individual pawl or actuating rod 63 for individually moving the segments angularly relative to the longitudinal axis of the shaft 45. Each segment 46 further has an electromagnetic actuator 65 associated therewith. Each of these actuators has an individual anchor 66 which acts on the corresponding pawl or rod 63 for an engagement of the corresponding ratchet teeth structure 61 and an angular stepping of the particular segment in accordance with the number of distinct energizations of the particular actuator 65. A mounting plate 68 carries the actuators 65 and is attached to the base plate 13 by a fastener 69.

The ends of the rods 63 adjacent the anchors 66 extend slidably through apertures 71 in a generally U-shaped guide frame 72 which is pivotally mounted on the carriage side plates 42 and 43 by studs 74. The bight portion of the frame 72 is supported by pins 76 which are slidably arranged within guide bars 78 which are attached to the mounting plate 68.

The active ends of the rods 63 adjacent the ratchet teeth structures 61 are loosely supported between crosspins 81 and 82 which extend between and are attached to the carriage side plates 42.

Each pawl or rod 63 has associated therewith an individual bent leaf spring 84 which biases the particular rod 63 and corresponding anchor 66 to a rest position. In the illustrated embodiment, the leaf springs 84 act between the particular rod and the crosspin 82.

A control 91 energizes the individual actuators 65 via lines 92 so as to set the segments 46 to predetermined angular positions as required for a printout of a desired character combination. The control 91, may provide one pulse for each step by which a given segment 46 is to be advanced. Pulsing of an actuator 65 will thus result in a corresponding oscillatory movement of its anchor 66 and a corresponding movement of the particular pawl or actuating rod 63 which will thus be moved along its longitudinal axis and will engage the ratchet teeth structure 61 at successive teeth. The ratchet teeth structures 61 translate longitudinal movement of each actuator rod 63 into individual angular movement of the corresponding segment 46. In this manner, the segments are set to their respective angular position for a printout of a predetermined combination.

The square shaft 48 or mounting member carries detent springs 94 which preferably correspond in number to the segments 46, whereby each segment has its own detent spring. If desired, the individual detent spring may be cut from one plate of spring metal which is then attached to the square shaft 48 and which has the detent members 94 as tines.

In the illustrated embodiment, the longitudinally actuated rods 63 cause the segments 46 to move angularly in a clockwise direction as seen in FIG. 1. The detents 94, in turn, prevent a counterclockwise return of the segments from any advanced position, as long as the detents 94 are biased into engagement with the ratchet teeth structures 61. The detents 94 thus act as releasable means for retaining the segments 46 in angularly advanced positions against the bias of springs 96. Each segment 46 has a spring 96 associated therewith for a bias of the segment toward a rest position and a resetting of the segment to that rest position upon a release of the detents 94, as more fully described in the further course of this disclosure.

The apparatus 10 has a print hammer structure 98 constructed for simultaneous entry into the notches 56 behind the selectively positioned character types 53 of the angularly moved segments. In the illustrated embodiment, the print hammer structure 98 is formed by a crossbar which extends between and is attached to the extreme ends of the legs 24 of the above mentioned yoke 23.

The yoke 23, the rod 27 and the solenoid 37 with its armature 38 constitute a means, being coupled to the print hammer structure 98, for actuating the angularly moved segments at the entered notches 56 with the print hammer structure 98 toward the platen 28 or printout surface for a printout of the characters on the selectively positioned character types. In a broader sense, the parts just described, as well as the compression or bias spring 32, constitute a means for selectively moving the segments 46 toward and away from the platen 28 or printout surface. To permit a certain relative movement between the print hammer structure 98 and the segment carriage 41, a clearance or slot 99 is provided in each of the carriage side plates 24 and 25 at the location of the print hammer structure 98.

In order to effect a printout of a selected or set character combination, the solenoid 37 is energized from the control 91 by an electric current pulse via a line 100. This attracts the anchor 38 to the solenoid proper 37, resulting in compression of the spring 32 and downward movement of the rod 27, yoke 23 and print hammer structure 98.

The print hammer structure 98 thereby enters the notches 56 behind the angularly positioned print characters adjacent the platen 28 or printout surface 29. This has an immediate centering and position retaining action on the selected character types 53. The rod 27, yoke 23 and print hammer structure 98 continue in their travel toward the platen 28 or printout surface, whereby the print hammer structure 98 advances the angularly adjusted segments 46 toward the platen 28 and presses the selected character types 53 against the printout surface via an ink ribbon 102.

The segment carriage 41 is thereby advanced together with the shaft 45 and segments 46 and against the bias of the spring 51 or of another spring (not shown) which may, for instance, be provided between the carriage 41 and a stationary part, such as one or both of the bars 15. The segments 46 are thus advanced by the print hammer structure 98 for a printout of the angularly adjusted characters 53.

In practice, great care has to be exercised to avoid any misprints, especially with respect to commercial paper, negotiable instruments, such as bank checks, and in other instances where printing of erroneous amounts or data could have very severe effects in terms of customer dissatisfaction, operational impairments, liability and financial loss. In this respect, the ratchet member and detent member combination 61 and 94 is coupled to the character printing device or character segment 46. In the preferred embodiment of FIG. 3, the ratchet member or wheel 61 is in fact integral with or part of the character segment 46, and that character segment is driven with the ratchet and detent member combination by intermittently advancing the ratchet member 61 with the pawl 63, as mentioned above.

Preparatory to a printing operation, a character of each printing device or segment 46 is designated or selected for printout, as indicated by a selector block 193 in FIG. 3. By way of example, the selector block may comprise a binary signal generating device which provides a line 194 with different binary signals indicating of the character or number that is desired to be printed out in the particular operation.

The character or number selection signal is applied via line 194 to the control 91 which issues a corresponding number of pulses via line 92 to the pawl actuator 65. That actuator, in turn, advances and retracts the pawl 63 as many times as the actuator 65 is energized by pulses from the line 92. In other words, the pawl 63, operating on the ratchet member 61, attempts to advance the printing segment 46 until the character indicated by the output signal of the selector 193 is positioned at the printout surface or platen 28.

During each actuation or forward thrust of the pawl 63, the detent spring 94 rides up one tooth of the ratchet member 61 and, upon passage of the crest of the particular tooth, snaps down onto the adjacent surface of the next tooth, thereby generating or emiting a click. In this respect, it should be noted that the expression "click" as herein employed is not intended to be limited to the familiar clicking sound heard during the operation of ratchet devices. Rather, such expression is intended to refer to any physically discernible manifestation of the snapping action of the detent member or spring as it snaps off a tooth or is passed by the crest or projecting edge of a tooth. The expression "click" thus extends to physical manifestations of the sudden motion of the snapping detent spring 94 or the beam-like transducing element 187, which, being partially coextensive with the detent spring 94, at least in part follows the motions of that leaf spring. In particular, the transducer or sensor beam 187 is bent outwardly as the detent leaf spring 94 rides up on a tooth in the course of advancement of the ratchet member 61 by one increment.

As the detent spring 94 then snaps back upon falling off the projecting edge of the particular tooth, the transducing element or sensor beam 187 snaps back also, thereby emitting an electric sensor signal via line 188. As mentioned above, the transducer 187 may comprise a ceramic piezoelectric element, which emits a signal in response to bending or similar physical force application.

The output signal of the transducer element is applied via line 188 and a line 196 to a pulse shaper 197. Such devices are frequently used in electronics, having the purpose of providing an essentially rectangular pulse or a spike pulse in response to irregularly shaped input pulses or signal oscillations. For instance, the transducing element 187 typically will emit via line 188 an oscillatory electric signal that is characterized by a peak of maximum amplitude and a subsequent series of oscillations of lesser amplitude, declining periodically or aperiodically, depending on the mechanical characteristics of the ratchet element 61, detent spring 94 and transducer element 187. In the pulse shaper 197, the maximum amplitude component or pulse of the transducer output signal is easily separated by a threshold device which lets the maximum amplitude pass but constitutes a barrier to oscillations of lesser amplitudes. The pulse shaper 197 may also provide such amplification or booster function on the transducer signal as required in a particular application. In general, a piezoelectric ceramic element used as transducer 187 will emit such a strong signal as to minimize required amplification. The threshold-type pulse shaper 197 also ignores any electric signal generated by the bending transducing device 187 as the detent spring 94 rides up the small slope of any tooth 182.

The pulse shaper 197 applies to a counter 198 as many pulses as there are clicks generated by the detent spring 94 during advancement of the print segment 46 by operation of the pawl 63. If the control 91 has issued via line 92 as many pulses as required by the character selected for printout via block 193 and line 194, it issues via a line 199 a "print ready" signal which is applied to the counter 198. Upon receipt of that signal, the counter 198 will apply to one of two inputs of a comparator 200 a signal indicating the number of pulses that have been received in the particular operation from the pulse shaper 194. The other input of the comparator 200 at that time also receives from the selector 193 via line 194 a signal indicative of the character which actually has been selected for printout.

Ideally, the character-indicative signals supplied by the selector 193 and counter 198 coincide, in that the print segment 46 has actually been advanced by the pawl 63 to position the desired character at the printout surface or platen 28. In that case, the comparator 200 will issue via a line 201 a signal indicating that the "shall" signal from the selector 193 and the "is" signal from the counter 198 match. The signal thus supplied by the comparator 200 via line 201 to the control 91 is a "print" signal, which causes the control to energize the solenoid 73 via line 100 to effect the above mentioned print operation.

If the printing apparatus has more than one segment, the components 197 et seq. have to be multiplied by a factor corresponding to the number of print segments. In that case, the control 91 only receives a "print" signal if the counting equipment 198 for all segments indicates that the actual segment advance has resulted in a positioning of desired characters as to all segments at the printout surface or platen 28.

If the or any print segment 46 for any reason has not been advanced for a printout of the desired character, then the particular comparator 200 will not receive matching inputs from the selector 193 and counter 198 and will thus not issue a "print" signal via line 201 to the control 91. Accordingly, the control will not energize the solenoid 37, thereby preventing a printout operation. The control 91 may then reset the printing segment or segments 46 by actuation of the solenoid 123 via line 125 and, if desired, at the same time issue an alarm, such as via a blinking lamp 203, to indicate to the operator that the particular printing cycle has failed as should be reinitiated. Of course, it is within the broad contemplation of the subject invention to effect the particular printing operation even if the segments have been advanced incorrectly, and to indicate then to the operator or user of the system that an error has been committed. In general, it is, however, preferable not to print an erroneous indication in the first place.

The control 91, as well as the components 193, 197, 198 and 200, may be implemented with state-of-the-art microprocessor technology.

If the printing segments 46 have been adjusted as desired in a given printing cycle, the solenoid 37 is energized by the control 91, whereby the print hammer structure 98 enters the notches 56 behind the angularly positioned print characters and moves the particular print characters into engagement with the ink ribbon 102 for a printout of these characters on any paper or other printout medium positioned on the platen 28. In the course of their downward travel, the segments 46 along with their mounting shaft 43 move away from the detent springs 94, which thereby become disengaged from the ratchet members 61, as shown in the above mentioned Neff Patent 4,015,521. The segments 46 are thereby freed from the restraint of the detent springs 94, preparatory to a resetting of these segments to their initial or rest position by the bias springs 96. To this end, a segment reset arm 104 is attached to the square shaft 48. A bent end of the arm 104 contains an insert 105 into which an adjustment pin 106 is threaded. The adjustment pin 106 extends through and has a head 107 resting against a lateral projection 108 of a detent trip lever 109 which is pivoted by means of a mounting bracket 110 relative to the top plate 14. A spring 112 extends around the pin 106 and maintains the parts 105 and 108 in mutually spaced relationship. Function and timing of the detent release may be adjusted by an adjustment of the spacing between parts 105 and 108 through appropriate rotation of the adjustment pin head 107.

The arm 104 angularly moves relative to the insert 105 and the square shaft 48 rotates relative to the carriage 41 as the segments 46 travel toward the printout surface 29. The segments 46 are thereby released from the restraint of the detents 94 as indicated above.

As in the above mentioned Neff patent, disengagement of the detents 94 from the ratchet teeth structures 61 does not at that instant result in an automatic reset of the segment 46. Rather, the detents 94 with associated equipment constitute only a first releasable means for retaining the segments 46 in angularly advanced positions against the bias of the springs 96. A second releasable means, distinct from the mentioned first releasable means, for retaining the segments 46 in their angularly advanced positions against the mentioned bias is constituted by the print hammer structure 98 with its associated equipment. In particular, the print hammer structure 98, when entering the notches 56 upon energization of the solenoid 37 retains the segments 46 in their angularly advanced positions as long as it remains in engagement with the segments at the notches 66.

The release arm 104 with associated equipment thereby act as a means for releasing the detents 94 or first releasable means after engagement of the segments 46 by the print hammer structure or engaging means 98. On the other hand, the compression spring 32 operates as a means for releasing the print hammer structure 98 or second releasable means and for returning the segments 46 in a direction away from the platen 28 or printout surface 29 after movement of these segments toward the platen 28 or printout surface 29.

In particular, after the pulse-like energization of the solenoid 37 for the execution of a printing stroke by the hammer structure 98 has stopped, the compression spring 32 is able to move the rod 27, yoke 23 and print hammer structure 98 away from the platen 28 or printout surface 29.

In this manner, the carriage 41 and the segments 46 will also be returned to their rest position shown in FIG. 3, such as by means of the bias provided by the spring 51 or by another spring (not shown) which may be provided between the carriage 41 and the top plate 14, for instance.

The solenoid 123 is mounted on the top plate 14 by a bracket 124 for the purpose of tripping the detent release lever 109 in response to energization from the control 91 via a line 125. When energized, the solenoid 123 assures that all segments 46 will be in their initial or rest position shown in FIG. 3 before the next printing operation commences. Accordingly, the control 91 may routinely energize the solenoid 123 at the end of each printing operation to make sure that all segments are reset. In maximum security or reliability situations, an additional feature may be employed in accordance with the disclosure of the above mentioned Neff patent. In particular, a photocell or other sensor 128 may be employed to detect any resetting failure of a character segment. The photocell 128 is illuminated by a light source (not shown) which projects a beam of light across the segment assembly in the carriage 41, essentially in parallel to the longitudinal axis of the shaft 45.

The control 91 determines at the end of a printing operation whether the photocell 128 is supplying a signal via a line 133. If the beam emitted by the light source 129 is not obstructed by any segment, then the photocell 128 will provide the control 91 with an electric signal via line 133. On the other hand, the photocell 128 will not be able to develop such an illumination responsive signal if the beam issued by the light source 129 is obstructed by any segment that has failed to reset because breakage of the spring 96, malfunction of the detent 94 or for any other reason. In that case, the control 91 will determine at the end of a printing operation that the signal from the photocell 128 is not forthcoming. In that case, the control may take any action appropriate to the occasion, such as a shutting down of the printing operation, the release of an alarm or any combination of these and other measures.

On the other hand, and as disclosed in the above mentioned Neff patent, the feature involving the solenoid 123 is not always necessary in practice, and the automatic reset of the segments 46 may be improved by an imposition of a predetermined time delay on the movement of the detents 94 or other temporary segment retaining means.

The printing ribbon 102 employed in the apparatus 10 may be of a magnetic ink or any other suitable type, being supplied from a supply reel 16 via a roller 162 to the area of the printout platen 22, and being taken up by a takeup reel 164 via a roller 165 in the manner described in the above mentioned Neff patent.

Figure 4:
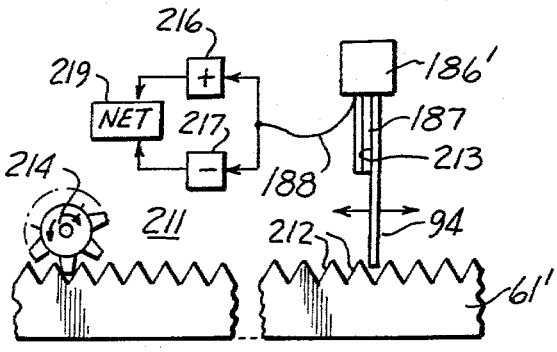
FIG. 4 is a view similar to FIG. 1 showing a position and motion monitoring apparatus in accordance with a further preferred embodiment of the subject invention.

The widespread utility of the subject invention is further illustrated in FIG. 4, showing a position and motion monitoring apparatus 211 in accordance with a further preferred embodiment of the subject invention.

The apparatus of FIG. 4 has a rack 61' having a series of structural discontinuities in the form of teeth 212.

Unlike the teeth 182 of the ratchet wheel or member 61, the latter teeth 212 have symmetrical slopes. In other words, the teeth 212 are of an isosceles configuration.

The transducer or piezoelectric element 187 is bonded to the leaf spring 94 at 213 so as to be bendable thereby in each of the two directions indicated by the oppositely pointing arrows in FIG. 4. A mounting block 186', which may be relatively stationary, mounts the elements 94 and 187 for recurrent contacting of the spring 94 and flexure of the spring 94 and transducer element 187 by the teeth 212 upon relative motion between the elements of the rack and spring combination 61' and 94. Such relative motion may, for instance, be imposed on the rack 61' by a drive including a pinion 214 which may be rotated in either direction.

If the pinion 214 is rotated clockwise as seen in FIG. 4, the rack 61' moves to the left and the spring 94 and transducer element 187 are jointly and repeatedly flexed to the left as successive teeth 212 contact the tip of the spring 94. After each such flexure, the spring 94 and bonded element 187 will snap back from the maximum flexed position, whereby emitting typically a click or at least undergoing a corresponding physically discernible manifestation.

Each time the spring 94 emits such a click or undergoes a corresponding manifestation, the bonded transducer element 187 emits via output line 188 a first electric signal, such as a signal of positive polarity.

Conversely, if the pinion 214 is rotated counterclockwise as seen in FIG. 4, the rack 61' is moved to the right, and the spring 94 and bonded element 187 are recurringly flexed to the right through contact of the spring 94 by successive teeth 212. Between each such contact, the spring 94 and element 187 snap back from their maximum flexure, thereby emitting also a click or undergoing a similar physically discernible manifestation.

In response to each such latter manifestation, the transducing element 187 emits via output line 188 a second electric signal, such as a signal of a negative polarity. In particular, if the above mentioned "bimorph" piezoceramic element is used at 187, signals with a positive peak will be emitted via line 188 in response to snapping release from a flexed position in a first direction, and signals with a negative peak will be emitted via line 188 in response to snapping release from a flexed position in an opposite second direction.

The output signals or pulses of the transducing element 187 are applied via lead 188 to two pulse shaping and counting devices 216 and 217. Each of these devices may include a pulse shaper and counter of the type of pulse shaper 197 and counter 198 shown in FIG. 3 and discussed above.

In addition, each device 216 and 217 includes a polarity sensitive or distinguishing circuit. Circuits which are capable of distinguishing the polarity of an input signal are well known and include, for instance, circuits which compare an input signal to a reference voltage. The device 216 thus counts the positive signal peaks emitted by the transducer element 187, and the element 217 counts the number of negative signal peaks emitted by the element 187. A circuit 219 nets the outputs of the counting devices 216 and 217 and thereby determines the net amount of motion of the rack 61' or the position of such rack relative to the spring 94 or to another reference point. The netting circuit 219 may also be composed of conventional elements, such as a circuit which subtracts one of the outputs of the counting elements 216 and 217 from the output of the other of these counting elements.

If desired, the rack 61' may be replaced by a gear wheel or similar dented rotary structure. Also, the teeth 182 and 212 herein shown constitute only examples of a series of structural discontinuities by which a member 94 or 187 is elastically deformable.

Broadly speaking, the subject invention resides in methods and apparatus for ascertaining the existence of a predetermined relative position between a first member 61 or 61' having a series of structural discontinuities 182 or 212 and a second member 94 and/or 187 elastically deformable by the structural discontinuities 182 or 212.

Relative movement is effected between the first and second members in order to realize the desired relative position and elastic deformations are generated in the second member 94 or 187 with the structural discontinuities 182 or 212 during that relative movement. The element 187 transduces these elastic deformations into electric signals and the circuitry 197, 198 and 200 or 216, 217 and 219 ascertains attainment of the relative position from the electric signals. To this end, the circuit 219 may have desired position indicating and comparison components, such as shown at 193 and 200 in FIG. 3. Similarly, the subject invention provides methods and apparatus for ascertaining amount of movement of a device, such as the printing segment 46 shown in FIG. 3 or the rack 61' shown in FIG. 4, or movable structure connected to such rack or corresponding rotary structure. In the latter case, the rack 61' would be moved in proportion to movement of the particular structure, such as the ratchet member 61 is moved in proportion to the movement of the print segment 46.

With particular reference to FIG. 4 and to the principle it embodies, the subject invention also provides methods and apparatus for ascertaining amount of movement of a device such as the part of the bar 61' engaged by the pinion 214 or other movable structure connected thereto. A first member 61' is provided with a series of structural discontinuities 212 and a second 94 or 187 is elastically deformable by the structural discontinuities 212.

Relative movement is effected between the first and second members, such as by means of a drive including the pinion 214.

In particular, relative movement between the first and second members 61' and 94 is effected in a first sense in proportion to movement of the device in a first direction and first elastic deformations are generated in the second member 94 and/or 187 with the structural discontinuities 212 during that relative movement in a first sense, such as to the left, as seen in FIG. 4. Alternatively, relative movement between the first and second members is effected in a second sense, such as to the right as seen in FIG. 4, in proportion to movement in a second direction of the device which the rack 61' embodies or to which it is coupled. Second elastic deformations are thereby generated in the second member with the structural discontinuities 212 during relative movement in that second sense. The piezoelectric element 187 transduces the first elastic deformations into first electric signals and the second elastic deformations into second electric signals, distinguishable from the first electric signals. The circuitry 216, 217 and 219 then determines from the first and second electric signals the amount of movement of the device which the rack 61 embodies or to which it is connected. As shown in FIG.

4 and disclosed above, net amount of movement may be determined in this manner, such as from a comparison of the first and second electric signals. By way of example, the embodiment of FIG. 4 may be employed to determine net positions of printing types in a kind of printing mechanism of the type disclosed in the above mentioned U.S. Pat. No. 2,039,791, with the bar mounting the types being then bidirectionally movable or steppable.

The subject extensive disclosure renders apparent or suggests to those skilled in the art various modifications and variations within the spirit and scope of the subject invention.

We claim:

1. A method of ascertaining the existence of a predetermined relative position between a ratchet member and a leaf spring, comprising in combination the steps of:

providing said ratchet member with ratchet teeth each having a projecting edge;

providing a transducer element emitting an electric signal in response to bending;

rendering said transducer element coextensive with part of said leaf spring;

applying said leaf spring to the ratchet member and effecting relative movement between the ratchet member and the leaf spring in order to realize said relative position and to cause the leaf spring to ride up on a tooth at a time and bend the partially coextensive transducer element and to snap back off the projecting edge of the tooth;

emitting with said transducer element an electric signal each time the bent transducer element snaps back after said leaf spring; and ascertaining from electric signals thus emitted an attainment of said relative position.

2. A method of ascertaining movement of a device from a first position to a second position, comprising in combination the steps of:

providing a ratchet member with ratchet teeth each having a projecting edge;

providing a leaf spring;

providing a transducer element emitting an electric signal in response to bending;

rendering said transducer element coextensive with part of said leaf spring;

applying said leaf spring to the ratchet member to provide a ratchet and detent combination;

coupling the ratchet and detent combination to said movable device;

attempting movement of said device from the first to the second position thereby effecting relative movement between the ratchet member and the leaf spring to cause the leaf spring to ride up on a tooth at a time and bend the partially coextensive transducer element and to snap back off the projecting edge of the tooth;

emitting with said transducer element an electric signal each time the bent transducer element snaps back after said leaf spring; and ascertaining from electric signals thus emitted whether said attempted movement has resulted in movement of said device from the first to the second position.

3. A method as claimed in claim 2, wherein:

said device is moved with said ratchet and detent combination by intermittently advancing said ratchet member with a pawl.

4. A method of operating a movable character printing device, comprising in combination the steps of:

providing a ratchet member with ratchet teeth each having a projecting edge;

providing a leaf spring;

providing a transducer element emitting an electric signal in response to bending;

rendering said transducer element coextensive with part of said leaf spring;

applying said leaf spring to the ratchet member to provide a ratchet and detent combination;

coupling the ratchet and detent combination to said character printing device;

designating a character of said character printing device for printout;

attempting movement of said character printing device for presentation of said character for printout thereby effecting relative movement between the ratchet member and the leaf spring to cause the leaf spring to ride up on a tooth at a time and bend the partially coextensive transducer element and to snap back off the projecting edge of the tooth;

emitting with said transducer element an electric signal each time the bent transducer element snaps back after said leaf spring;

ascertaining from electric signals thus emitted whether said attempted movement has resulted in presentation of said character for printout;

inhibiting printout as long as said attempted movement has failed to result in said presentation of said character; and effecting printout when said attempted movement has resulted in said presentation of said character.

5. A method as claimed in claim 4, wherein:

said character printing device is driven with said ratchet and detent combination by intermittently advancing said ratchet member with a pawl.

6. Apparatus for ascertaining the existence of a predetermined relative position between a ratchet member having ratchet teeth with projecting edges and a leaf spring riding up on a ratchet tooth at a time and bending, and threafter snapping back off a projecting edge of the tooth, comprising in combination:

a transducer element emitting an electric signal in response to bending;

means for effecting relative movement between the ratchet member and the leaf spring in order to realize said relative position;

means for emitting electric signals with said transducer element during said relative movement, including means for rendering said transducer element coextensive with part of said leaf spring for bending of, and emission of an electric signal by, said transducer element each time said leaf spring snaps back off a projecting edge of a ratchet tooth; and means connected to said emitting means for ascertaining from said electric signals attainment of said relative position.

7. Apparatus for ascertaining movement of a device from a first position to a second position, comprising in combination:

a ratchet member including ratchet teeth each having a projecting edge;

a leaf spring;

a transducer element emitting an electric signal in response to bending;

means for rendering said transducer element coextensive with part of said leaf spring;

means for applying said leaf spring to the ratchet member to provide a ratchet and a detent combination;

means for coupling the ratchet and detent combination to said movable device;

means for attempting movement of said device from the first to the second position thereby effecting relative movement between the ratchet member and the leaf spring to cause the leaf spring to ride up on a tooth at a time and bend the partially coextensive transducer element and to snap back off the projecting edge of the tooth;

means for emitting with said transducer element an electric signal each time the bent transducer element snaps back after said leaf spring; and means connected to said emitting means for ascertaining from electric signals thus emitted whether said attempted movement has resulted in movement of said device from the first to the second position.

8. Apparatus as claimed in claim 7, wherein:

said means for attempting movement of said device include a pawl for intermittently advancing said ratchet member.

9. Apparatus for operating a movable character printing device, comprising in combination:

a ratchet member including ratchet teeth each having a projecting edge;

a leaf spring;

a transducer element emitting an electric signal in response to bending;

means for rendering said transducer element coextensive with part of said leaf spring;

means for applying said leaf spring to the ratchet member to provide a ratchet and detent combination;

means for coupling the ratchet and detent combination to said character printing device;

means for designating a character of said character printing device for printout;

means connected to said character designating means for attempting movement of said character printing device for presentation of said character for printout thereby effecting relative movement between the ratchet member and the leaf spring to cause the leaf spring to ride up on a tooth at a time and bend the partially coextensive transducer element and to snap back off the projecting edge of the tooth;

means for emitting with said transducer element an electric signal each time the bent transducer element snaps back after said leaf spring;

means connected to said emitting means for ascertaining from electric signals thus emitted whether said attempted movement has resulted in presentation of said character for printout; and means connected to said ascertaining means for inhibiting printout as long as said attempted movement has failed to result in said presentation of said character and for effecting printout when said attempted movement has resulted in said presentation of said character.

10. Apparatus as claimed in claim 9, wherein:

said means for attempting movement of said character printing device include a pawl for intermittently advancing said character printing device through said ratchet member.

11. Apparatus as claimed in claim 9 or 10, wherein:

said transducer element is a piezoelectric element partially coextensive with said leaf spring.

12. Apparatus for ascertaining the existence of a predetermined relative position between a ratchet member and a detent member, comprising in combination:

means coupled to the detent member for applying the detent member to the ratchet member;

means for generating clicks by effective relative movement between the ratchet member and applied detent member in order to realize said relative position; and means coupled to said generating means for ascertaining from said generated clicks the attainment of said relative position, said ascertaining means including means for transducing said clicks to electric signals and means connected to said transducing means for ascertaining the attainment of said relative position from said electric signals, and said transducing means including a piezoelectric element coupled to said detent member.

13. Apparatus as claimed in clam 12, wherein:

said ascertaining means include means for counting said clicks and means connected to said counting means for ascertaining the attainment of said relative position from the number of said counted clicks.

14. Apparatus for ascertaining movement of a device from a first position to a second position, comprising in combination:

means for generating clicks including a ratchet member and detent member combination;

means coupled to said device for moving said device from said first to said second position;

means coupled to said ratchet and detent member combination and to said device for effecting relative motion between the ratchet member and detent member in said ratchet and detent member combination and generation of said clicks in accordance with the movement of said device; and means coupled to said generating means for ascertaining from said generated clicks whether said moving means have moved said device from the first to the second position, said ascertaining means including means for transducing said clicks to electric signals and means connected to said transducing means for ascertaining from said electric signals whether said moving means have moved said device from the first to the second position, and said transducing means including a piezoelectric element coupled to said detent member.

15. Apparatus as claimed in claim 14, wherein:

said ascertaining means include means for counting said generated clicks and means connected to said counting means for ascertaining from the number of said counted clicks whether said moving means have moved said device from the first to the second position.

16. Apparatus as claimed in claim 14, wherein:

said moving means include means coupled to said ratchet and detent member combination and including a pawl for driving said device through said ratchet and detent member combination.

17. Apparatus for printing characters, comprising in combination:

a movable character printing device;

means coupled to said movable character printing device for presenting any character of said character printing device for printout;

means for generating clicks including a ratchet member and detent member combination;

means for designating a desired character in said character printing device for printout;

means coupled to said designating means, presenting means and ratchet and detent member combination for moving said character printing device for presentation of said desired character for printout and effective relative motion between the ratchet member and detent member in said ratchet and detent member combination and generation of said clicks in accordance with the movement of said character printing device;

means coupled to said designating means and generating means for ascertaining from said clicks whether said moving means have moved said character printing device for presentation of said desired character for printout; and means connected to said ascertaining means for inhibiting printout as long as said moving means have failed to move said character printing device for presentation of said desired character for printout and for effecting printout upon ascertainment that said desired character is being presented for printout, said ascertaining means include means for transducing said clicks to electric signals and means connected to said transducing means for ascertaining from said electric signals whether said desired character is being presented for printout, and said transducing means including a piezoelectric element coupled to said detent member.

18. Apparatus for ascertaining the existence of a predetermined relative position between a ratchet member and a detent member, comprising in combination:

means coupled to the detent member for applying the detent member to the ratchet member;

means for generating clicks by effecting relative movement between the ratchet member and applied detent member in order to realize said relative position; and means coupled to said generating means for ascertaining from said generated clicks the attainment of said relative position, said ascertaining means including means for transducing said clicks to electric signals and means connected to said transducing means for ascertaining the attainment of said relative position from said electric signals, said detent member comprising a leaf spring engaging said ratchet member; and said transducing means including a transducing element coextensive with part of said leaf spring.

19. Apparatus for printing characters, comprising in combination:

a movable character printing device;

means coupled to said movable character printing device for presenting any character of said character printing device for printout;

means for generating clicks including a ratchet member and detent member combination;

means for designating a desired character in said character printing device for printout;

means coupled to said designating means, presenting means and ratchet and detent member combination for moving said character printing device for presentation of said desired character for printout and effecting relative motion between the ratchet member and detent member in said ratchet and detent member combination and generation of said clicks in accordance with the movemet of said character printing device;

means coupled to said designating means and generating means for ascertaining from said clicks whether said moving means have moved said character printing device for presentation of said desired character for printout; and means connected to said ascertaining means for inhibiting printout as long as said moving means have failed to move said character printing device for presentation of said desired character for printout and for effecting printout upon ascertainment that said desired character is being presented for printout, said ascertaining means including means for transducing said clicks to electric signals and means connected to said transducing means for ascertaining from said electric signals whether said desired character is being presented for printout, said detent member comprising a leaf spring engaging said ratchet member, and said transducing means including a transducing element coextensive with part of said leaf spring.

20. Apparatus as claimed in claim 19, wherein:

said ascertaining means include means for counting said clicks and means connected to said counting means for ascertaining from the number of counted clicks whether said desired character is being presented for printout.

21. Apparatus for ascertaining movement of a device from a first position to a second position, comprising in combination:

means for generating clicks including a ratchet member and detent member combination;

means coupled to said device for moving said device from said first to said second position;

means coupled to said ratchet and detent member combination and to said device for effecting relative motion between the ratchet member and detent member in said ratchet and detent member combination and generation of said clicks in accordance with the movement of said device; and means coupled to said generating means for ascertaining from said generated clicks whether said moving means have moved said device from the first to the second position, said ascertaining means including means for transducing said clicks to electric signal and means connected to said transducing means for ascertaining from said electric signals whether said moving means have moved said device from the first to the second position, said detent member comprising a leaf spring engaging said ratchet member, and said transducing means including a transducing element coextensive with part of said leaf spring.

22. Apparatus as claimed in claim 19 or 20 wherein:

said moving means include means coupled to said ratchet and detent member combination and including a pawl for driving said movable character printing device through said ratchet and detent member combination.

23. Apparatus as claimed in claim 12, 13, 14, 15, 16, 19, or 20, wherein:

said ratchet member is a ratchet wheel.

* * * * *